US006184452B1

(12) United States Patent
Long et al.

(10) Patent No.: US 6,184,452 B1
(45) Date of Patent: Feb. 6, 2001

(54) TUNING OF MUSICAL INSTRUMENTS

(76) Inventors: Peter Graham Long, The Green Upper Poppleton, York Y02 6DR; Paul Stephen Osborne, Cobi House, Sycamore Lane, Sheffield S30 6J2; Jonathan Edward Ensor, 18 Lindley Drive Parbold, Wigan, Lancashire WN8 7ED; Graham George Cole, 63 St. Swithin'Walk, Holgate, York Y02 4U6, all of (GB)

( * ) Notice: Under 35 U.S.C. 154(b), the term of this patent shall be extended for 0 days.

(21) Appl. No.: 09/331,549

(22) PCT Filed: Dec. 19, 1997

(86) PCT No.: PCT/GB97/03373

§ 371 Date: Jun. 18, 1999

§ 102(e) Date: Jun. 18, 1999

(87) PCT Pub. No.: WO98/28732

PCT Pub. Date: Jul. 2, 1998

(30) Foreign Application Priority Data

Dec. 20, 1996 (GB) ..... 9626530
Oct. 31, 1997 (GB) ..... 9722985

(51) Int. Cl.[7] ..... G10D 7/02

(52) U.S. Cl. ..... 84/457; 84/723; 84/724; 84/725

(58) Field of Search ..... 84/723–728, 730–731, 84/454, 455, DIG. 18, DIG. 24

(56) References Cited

U.S. PATENT DOCUMENTS 4,378,721 * 4/1983 Kaneko et al. ..... 84/1.14
4,817,484 * 4/1989 Iba et al. ..... 84/1.16
5,025,703 * 6/1991 Iba et al. ..... 84/718
5,121,669 * 6/1992 Iba et al. ..... 84/735
5,343,793 * 9/1994 Pattie ..... 84/454
5,585,588 * 12/1996 Tumura ..... 84/726
5,717,155 * 2/1998 Szalay ..... 84/723
5,744,744 * 4/1998 Wakunda ..... 84/650
5,945,621 * 8/1999 Ishebashi ..... 84/627
5,945,622 * 11/1999 Yamada ..... 84/731
5,990,408 * 11/1999 Hasebe ..... 84/723
6,046,397 * 4/2000 Rose ..... 84/743

* cited by examiner

*Primary Examiner*—Jeffrey Donels
*Assistant Examiner*—Kim Lockett
(74) *Attorney, Agent, or Firm*—Lee, Mann, Smith, McWilliams, Sweeney & Qhlson

(57) ABSTRACT

An electric guitar has an electromagnetic resonating unit (3) which is arranged to resonate the strings (2) of the guitar, either individually or together. The resonance of each string is picked up by a pick-up unit (4), and the frequency of resonation of the string is detected and compared with a desired value. A tension adjusting unit (5) adjusts the tension in each string (2) until the frequency of resonance of the string correponds to the desired frequency, in order to tune the guitar to a desired tuning pattern. A control panel (6) on the body (1) of the guitar displays optional tuning patterns which may be selected by a user. Automatic tuning of the guitar may be achieved, without requiring the strings to be plucked manually.

38 Claims, 5 Drawing Sheets

TUNING OF MUSICAL INSTRUMENTS

This invention relates to the tuning of musical instruments.

The tuning of musical instruments, prior to rehearsal or performance, is essential but also tedious and time consuming. Most tuning is done using the human ear as a means of determining whether the sounded note is correct or if it needs to be adjusted up or down in pitch. This process has the disadvantage of requiring subjective rather than an objective decision.

To overcome this problem, a number of portable instruments have been devised, which provide a visual indication to the user of the instrument of the sounded note's pitch, enabling the user to see if this note agrees with a predetermined pitch or if adjustment is necessary and in which direction. However, the user must still make the necessary manual tuning adjustments.

Such manual tuning is often difficult and time consuming. During a performance or group rehearsal, when many instruments may be tuned simultaneously and there may be considerable extraneous noise, the problem is exacerbated.

U.S. Pat. No. 4,196,652 describes a Digital Electronic Tuner which primarily indicates whether or not a note is in tune, by means of a sequence of light emitting diodes. The specification suggests that in one embodiment of the invention "a stepping motor could be used to automatically tune an instrument" but no description is given of how such a motor might be connected to an instrument, except via a "tuning wrench" or "tuning hammer", which suggests the tuning of instruments such as pianos. The disclosure concentrates primarily on digital processing, decision making and indicating means.

FR 2 196 102 describes an automatic tuning system for a guitar. The system is designed to be fitted in an acoustic guitar (FIG. 3), but little practical guidance is given as to how this might be done. The system uses analogue filters and motors with multiple shunt-wound field windings to determine the control required and to adjust the tension in the strings. A miniature microphone is used as the transducer for turning the acoustic sound into an electrical signal.

Other patents that disclose allegedly automatic means for tuning stringed instruments include U.S. Pat. No. 4,803,908, which is arranged to tune all strings simultaneously; U.S. Pat. No. 4,909,126, which incorporates a pivotable tune lever arm means, U.S. Pat. No. 4,584,923, which has a plurality of motor means for the plurality of strings, and a particular mechanical linkage; U.S. Pat. No. 5,390,579, which is concerned with a particular mechanical arrangement for adjusting tension of the string, and preferably includes a tremolo arm; and U.S. Pat. No. 5,343,793, which discloses a means for automatically and continuously tuning an instrument, and detects whether or not a string is in contact with a fret.

A common feature of all of these prior patent publications is that none of them contemplates positive excitation of the string, in the tuning process. All of them rely upon the player playing the respective string or strings to be tuned. In this way, none of these prior systems can be truly automatic, all require the participation of the instrument player.

U.S. Pat. No. 5,065,660 discloses a piano tuning system. A clamp-on probe clamps on to adjacent strings of a piano and resonates a chosen string by means of a feedback loop at a frequency which is electronically compared to an accurate reference frequency. An associated electronic circuit controls an electric motor driven mechanism which is engaged with the respective existing tuning pin of the piano (just one pin at a time), to adjust the string tension the correct frequency is achieved. A feature of this system is that it is fitted only as an extraneous temporary accessory for a piano, during the operation of which the piano is not playable. The use of the clamp-on probe renders certain strings unplayable, whilst the probe is fitted.

According to one aspect of the present invention, there is provided an automatic tuning system for a stringed musical instrument having a plurality of strings, the system comprising:

a. electrically driven resonating means arranged to resonate a string at its fundamental frequency, with an air gap between the resonating means and the string;

b. resonating control means arranged to drive the resonating means;

c. detecting means arranged to detect the mechanical vibration of the string and to convert said vibration into a corresponding electrical signal;

d. comparing means arranged to compare the frequency of said electrical signal with a predetermined frequency and to output a comparison signal;

e. adjusting means arranged to adjust the tension in the string; and f. closed loop tuning control means arranged to receive said comparison signal and automatically control operation of said adjusting means until said comparison signal indicates that the frequency of said electrical signal is substantially equal to said predetermined frequency:

wherein:

g. the tuning system is adapted to be installed in the instrument as a permanent fixture such that:

i. said electrically driven resonating means is mounted as a permanent fixture in or on the body of the instrument such that it may resonate all of the strings of the instrument;

ii. said detecting means is mounted as a permanent fixture in or on the body of the instrument such that it may detect the mechanical vibration of all of the strings of the instrument;

iii. said adjusting means is mounted as a permanent fixture in or on the body of the instrument such that it may adjust the tension of all of the strings of the instrument;

iv. after installation, the tuning system maintains the tension of all of the strings of the instrument during normal playing, via said adjusting means, and requires no assembly or disassembly to or from the instrument, in order to carry out tuning; and v. the tuning system makes no contact with the strings of the instrument, both during normal playing of the instrument and during tuning, other than via said adjusting means.

Preferably, said resonating control means comprises electronic filter means arranged to progressively increase the permissible frequency of oscillation of a respective string until resonance occurs.

Preferably, said resonating control means comprises low-pass filter means for preventing resonance of a respective string at a harmonic above its fundamental frequency, once resonance has been established.

Preferably, said resonating control means is a closed loop control means utilising said resonating means and said detecting means, and arranged automatically to both initiate vibration of the string and maintain resonance of the string as said adjusting means is adjusted.

Preferably, said resonating control means comprises phase control means for maintaining substantially 0 degrees of overall phase in an oscillating loop which includes a respective string, to maintain resonance of the string as said adjusting means is adjusted.

Preferably, said comparing means is arranged to compare said frequencies by measuring the time period of said electrical signal and comparing it with the time period of said predetermined frequency.

Preferably, said resonating means comprises an electromagnetic transducer.

Preferably, said resonating means comprises a respective electromagnetic transducer element for each string to be tuned.

Preferably, said detecting means comprises an electromagnetic transducer.

Preferably, said detecting means comprises a respective electromagnetic transducer element for each string to be tuned.

An automatic tuning system as above may further comprise a noise detecting means for detecting noise in the vicinity of said detecting means, including noise from said resonating means, and combining means for so combining signals from said first-mentioned detecting means and said noise detecting means as to wholly or partially cancel noise common to both said first-mentioned detecting means and said noise detecting means.

Preferably, said noise detecting means comprises a pick-up coil mounted adjacent said first-mentioned detecting means.

Preferably, said adjusting means comprises at least one electric motor.

Preferably, said adjusting means comprises one electric motor and a plurality of drive selectors to connect the drive of said one motor selectively to respective ones of the strings.

Preferably, each of said drive selectors comprises a respective clutch.

Preferably, a respective electromagnetic actuator is provided to engage and disengage each respective clutch.

Preferably, said adjusting means comprises a worm drive and a plurality of output gears, each of which engages the worm drive and drives a respective output shaft for a respective one of said strings.

Preferably, said adjusting means comprises for the or each string a respective rotatable shaft around which the string is wound, such that rotation of the shaft varies the tension in the string.

Preferably, the or each said rotatable shaft is adapted to be rotated by a gear which rotates with the shaft and is driven by a worm.

An automatic tuning system as above may further comprise a control panel or unit by which a user can initiate and/or control a tuning operation.

Preferably, said tuning control means is arranged to tune all of a plurality of strings to a predetermined tuning pattern, and said control panel or unit includes means for setting said tuning pattern.

Preferably, said tuning control means stores a plurality of predetermined tuning patterns, and said control panel or unit includes means for selecting one of said stored tuning patterns.

Preferably, at least one of said plurality of predetermined tuning patterns comprises a predetermined chord.

Preferably, said tuning control means is arranged to detect the frequency of a selected string and to tune all of the other strings to a predetermined tuning pattern, based on said selected string.

Preferably, said means for setting said storing pattern is arranged to store the tuning pattern of the strings at any time selected by the user, and to subsequently retune the strings to that tuning pattern.

Preferably, said tuning control means includes means for adjusting the pitch of all of the strings in unison.

Said control panel or unit may comprise a control panel mounted in or on the instrument and/or a control unit remote from the instrument.

Signal processing electronics may be housed within the instrument.

An automatic tuning system as above may further comprise indicating means arranged to indicate the status of tuning, during tuning and/or upon completion of tuning.

Said indicating means may comprise an audible signal generator.

Said indicating means may comprise a visual display unit.

An automatic tuning system as above may be arranged to tune the strings individually, one at a time.

An automatic tuning system as above may be arranged to tune some or all of the strings simultaneously.

Preferably, an automatic tuning system as above is arranged to tune a guitar.

According to another aspect of the present invention, there is provided a stringed musical instrument provided with an automatic tuning system according to any of the preceding aspects of the invention.

The stringed musical instrument may be a guitar, and preferably an electric guitar.

One embodiment of the invention has the following features.

The means for resonating the string consists of an electromagnet, the current in which is modulated to produce a vibration in the string, which is responsive to magnetism, either because the string is made of steel or because the wound metal cover of the string is responsive to magnetism. A separate inductive magnetic pick-up is used to detect the vibration in the string. The resulting signal is used to optimise the resonance of the string so that the frequency of the modulation of the current in the electromagnet becomes the natural resonance frequency of the string. This signal is also used by signal processing circuitry to determine whether the string is "in-tune" or needs adjusting.

In operation, the player may select one of a range of chords by pressing an appropriate button or selection device, on a control panel within the instrument or, alternatively, on a remote control unit. A typical range of chord patterns is given in the following table for illustration of the principle. The system will then immediately, or when requested to do so, proceed to energise the strings, compare the resultant frequency signals with the selected ones (derived from a quartz crystal oscillator or other reference source), adjust each string tension to bring the string frequency to correspond to the selected frequency and then indicate when each one or all of the strings are in tune.

| | STRING NO | | | | | |
|---|---|---|---|---|---|---|
| TUNING PATTERN | 6 | 5 | 4 | 3 | 2 | 1 |
| Standard | E | A | D | G | B | E |
| "D" | D | A | D | F# | A | D |
| "G" | D | G | D | G | B | D |
| "E" | E | B | E | G# | B | E |
| "A" | E | A | E | A | C# | E |
| "Dropped" | D | A | D | G | B | E |

-continued

| TUNING PATTERN | STRING NO 6 | 5 | 4 | 3 | 2 | 1 |
|---|---|---|---|---|---|---|
| "Cross-key" | D | A | D | F | A | D |
| "Cross-key" | E | B | E | G | B | E |
| "Delta-blues" | E | A | C# | E | A | E |
| "C" | C | G | C | G | C | E |
| "Lap steel or Dobro" | G | B | D | G | B | D |
| "Dadgad" | D | A | D | G | A | D |

The signal processing means may use a digital signal processing (DSP) module to determine the relative frequency difference for each string and to control the resonating circuits. Alternatively a phase-locked-loop circuit may be used to control the resonating circuits and a separate frequency comparator system used to determine whether, by how much and in which direction, tension adjustment is to be carried out. Such signal processing means are known in the art, and therefore need not be described further here.

String tension is adjusted using a screw-and-nut type mechanism for each string in the body of the musical instrument. The string may either pass over or be attached to a movable block which may be propelled parallel to the length of the string by the rotation of a screw, also mounted parallel to the block, and passing through it with a nut-type thread engaging the screw. Each screw may be rotated by an individual motor, working through its own reduction gear box, or by one motor/gearbox linked mechanically by miniature, electrically operated clutches which engage the individual screws as and when the signal processing unit commands. The use of a screw-and-nut technique ensures that the string tension is maintained when the motor(s) and/or clutches are not energised. This mechanism can be housed conveniently within the body of the instrument leaving the distinctive head for separate manual tuning (e.g. during string replacement) and keeping the center of gravity of the instrument in the normal position.

The tuning mechanism may also allow special effects, such as pitch modulation at a selectable rate, to be accomplished as well as an overall adjustment of pitch for the whole instrument to ensure compatibility with other instruments in a group of players.

For a better understanding of the invention, and to show how embodiments of the same may be carried into effect, reference will now be made, by way of example, to the accompanying diagrammatic drawings, in which.

In the figures, like reference numerals denote like or corresponding parts.

Figure 1:
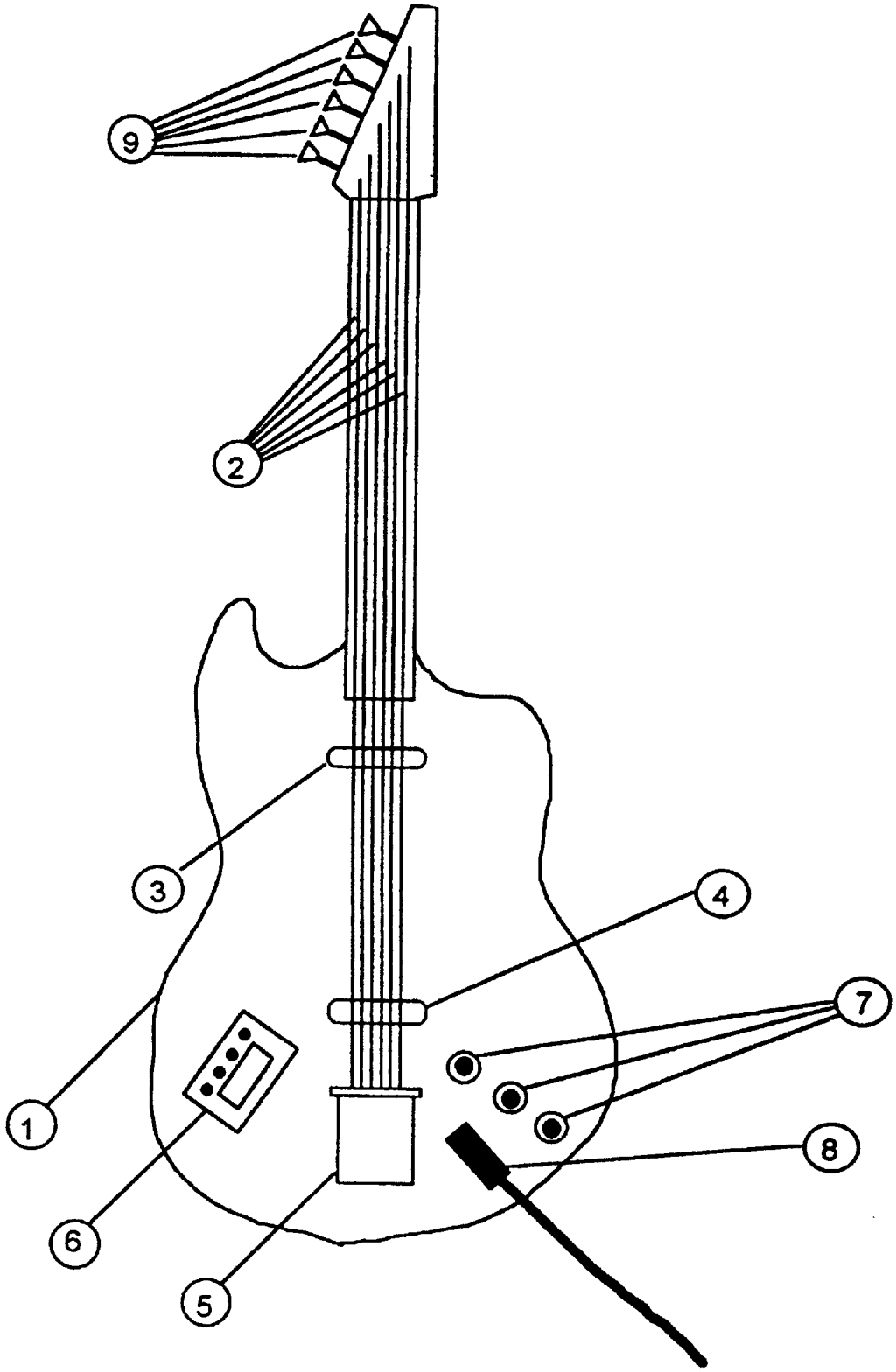
FIG. 1 shows the general appearance of an electric, solid body guitar and the location of visible components of a tuning system.

In FIG. 1, the main body 1 of the guitar has six strings 2 tensioned by pegs in the scroll or head 9. The other ends of the strings are connected to an automatic tensioning unit 5 positioned in the body of the guitar. The strings pass over a magnetic pick-up unit 3 in which six separate coils detect the vibration of each string independently. Closer to the tensioning unit 5, there is mounted a six output electromagnet unit 4 which is used to generate small resonant vibrations in the strings at appropriate times. A control panel 6, conveniently mounted to be easily visible by the player, indicates chords or other tuning patterns selected and when tuning is accomplished. Buttons/knobs on the control panel 6 allow the player to select predetermined chords as required and to initiate tuning. Also shown in the diagram are conventional audio output control knobs 7 and an audio jack plug 8 and lead to a power amplifier (not shown). The system can mute the audio output during tuning to avoid the resultant sounds being amplified.

Figure 2:
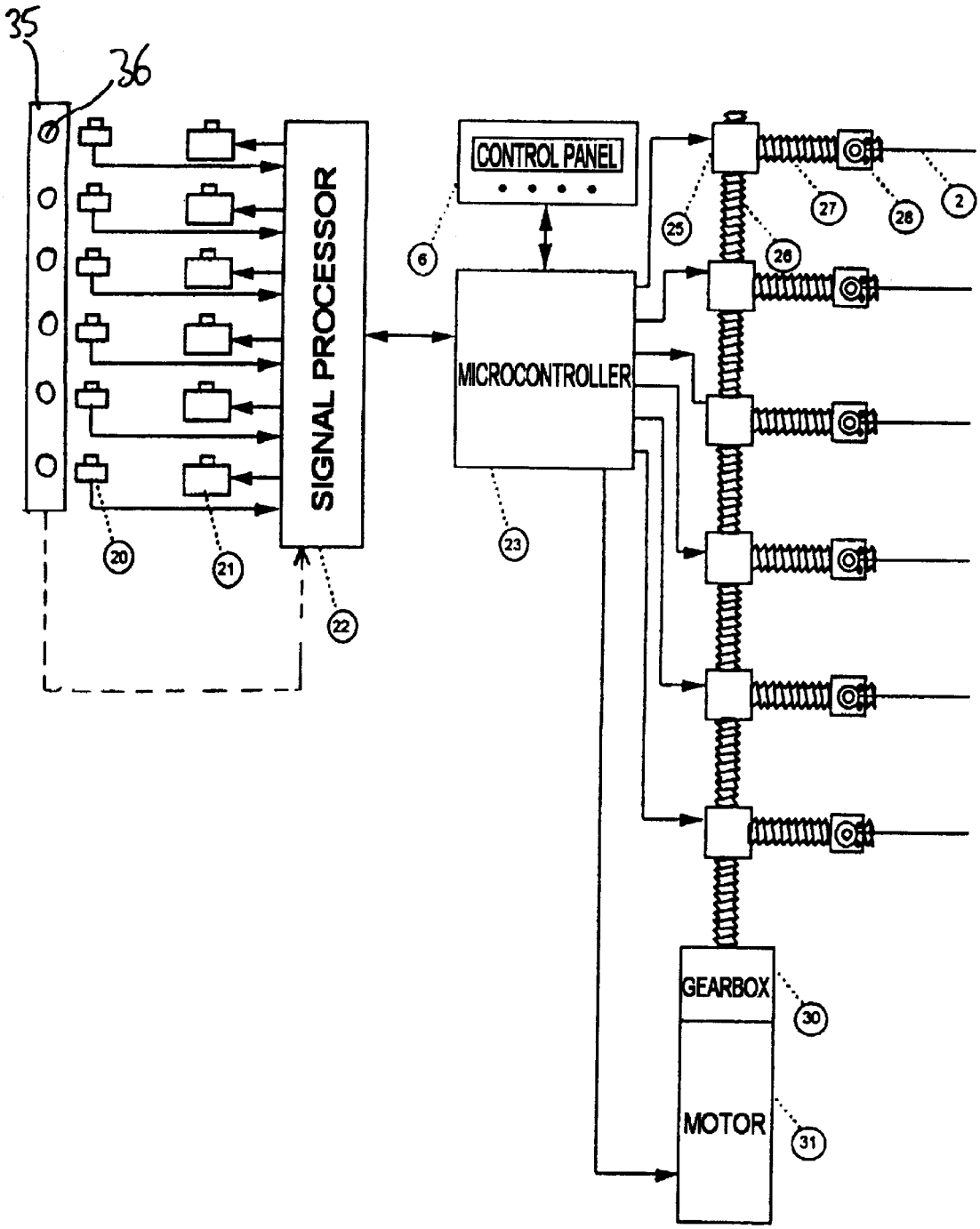
FIG. 2 is a general schematic view showing the interconnection of various components.

FIG. 2 shows a general schematic of the tuning system. Control panel 6 communicates with a microcontroller 23 in order to determine the tuning arrangement to be followed and to display information for the user on a display unit of the control panel 6. On initiation, after the user has selected one of a range of chords (or tuning patterns) from a displayed menu, and actuated a button or other control to commence tuning, the microcontroller 23 communicates with a signal processor unit 22, which may be included as an integral part of the microcontroller 23 but is shown separately here to aid explanation, and electromagnets 21 of the electromagnet unit 4 are energised in turn or simultaneously, each to cause a respective one of the strings to vibrate.

A respective inductive pick-up 20 of the pick-up unit 3 detects the vibration of each string and provides a feedback signal to the signal processor unit 22. A phase-locked-loop or DSP within the signal processor unit 22 adjusts the modulation frequency of the current in each appropriate electromagnet 21 so that each string 2 resonates at its natural fundamental frequency. These frequencies are communicated to the microcontroller 23. In the microcontroller 23, the actual frequency and the desired frequency are compared. For each string a decision results which then determines whether a motor 31 should turn clockwise or anti-clockwise to increase or decrease the string tension.

In FIG. 2, the drive of the motor 31 passes through a reduction gearbox 30 and is used to make adjustments to all of the strings. This is accomplished by using electromagnetic clutches 25 which are independently controlled by the microcontroller 23 so that one or more may be closed/energised when the motor 31 is turning, either clockwise or anti-clockwise. This enables a common drive screw 26 to be connected, via an internal cog wheel (not shown), to selected ones of six output screws 27, each for a respective individual string tensioner. The rotation of each output screw 27 causes a respective block 28 to which the string 2 is attached, or passes around, to be moved in line with the string, either to increase the tension or to decrease it. A separate, respective motor may alternatively be used for each string but, because of the relative cost of six motors, this tends to be a less economic solution. The block 28 has an internal screwthread so that it remains static when the screw 27 ceases to turn, thus maintaining the required tension in the string without the use of any power.

When each string 2 has reached the correct tension, with the final correction always being in the increasing tension direction to ensure minimal backlash problems, the microcontroller 23 will indicate completion of the tuning process to the player via the control panel 6. The audio output from the guitar may also be automatically muted during tuning. On completion, the audio output will be reinstated and a discrete note may be sounded to advise that the process is complete.

During the tension adjustment phase, the signal processing unit 22 causes the strings to sound at their resonant frequency by continuously adjusting the electromagnet current modulation. This enables the microcontroller 23 to determine on a continuous basis whether each string is being adjusted appropriately.

In exciting each string, there are two main steps. Firstly, starting the string oscillating at its fundamental frequency and, secondly, maintaining that oscillation as the frequency of the string is altered. A preferred method used to perform both of these steps creates a positive feedback loop around the string: the loop becomes an oscillator with the string as the resonant component. The string is excited by the respective electromagnet 21 to convert the electrical oscillation created by the feedback loop into a magnetic force on the string, and oscillation of the string is converted into an electrical signal by the respective pick-up 20.

When starting the oscillation, the permissible frequency of oscillation of the string is progressively increased over the working range of the string. For example, the range of possible frequencies which the fundamental may lie in, is split into three by the appropriate placement of a filter edge. In each of these bands, a respective phase network is switched on in turn and an excitation pulse is generated. If the lowest frequency band is tested first, followed by the middle band and finally the high frequency band, the first observed loop oscillation is guaranteed to be the fundamental frequency of the string.

When maintaining the string oscillation, a low-pass filter edge is placed at a frequency just above the fundamental in order to ensure that the string is not resonating at a harmonic above the fundamental. In order to guarantee that the loop will oscillate, phase components are switched into the circuit to maintain 0 degrees of overall phase at the required frequency.

Figure 3:
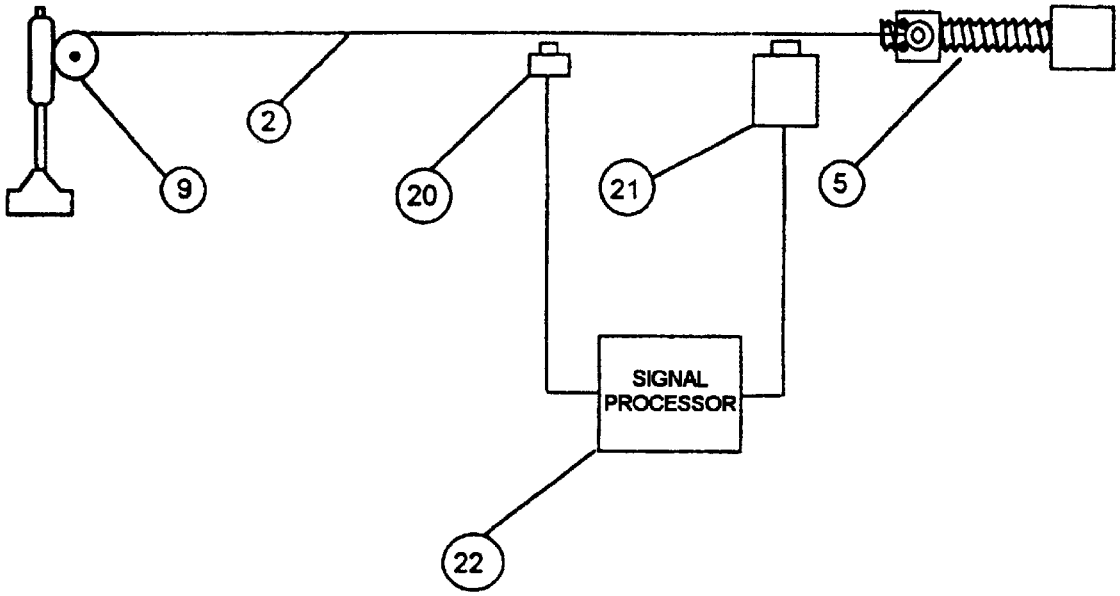
FIG. 3 illustrates a mechanism for making a string resonate at its fundamental frequency.

FIG. 3 illustrates how an electromagnet 21 causes a steel string 2, which responds to a magnetic force, to vibrate. By positioning the electromagnet 21 close to the end of the string, this enables the air gap between the string and the face of the electromagnet to be kept small in order to maximise the effect of the forces available. The magnetic pick-up 20 is placed as close to the center of the string 2 as is convenient, to facilitate detection of the fundamental frequency. The conventional worm-operated peg 9 is provided for manually adjusting string tension and the automatic tension adjuster 5 is housed in the body of the guitar.

The pick-up unit 3 may serve a dual purpose, to provide a normal output signal during performance, and also to provide a feedback output to the signal processing unit 22 during tuning. Electric guitars often have more than one pick-up unit. In such a case, any desired one or more of the pick-up units may be used for automatic tuning, but preferably that closest to the mid point of the string is used for this purpose.

In a preferred arrangement, an additional pick-up 35 is provided. This may be located in the vicinity of (for example, adjacent or below) the main pick-up unit 3. The purpose of the additional pick-up 35 is not to detect vibrations in any of the strings 2. On the contrary, its purpose is to detect noise or interference in the vicinity of the main pick-up unit 3, and particularly that caused by the transducers 21. The output signal of the additional pick-up 35 is processed together with that of the main pick-up unit 3 in the signal processor unit 22, in order that the common component of the noise or interference in both signals is cancelled and removed.

The additional pick-up 35 may have a plurality of individual coils 36, each associated with a respected individual pick-up 20 of the main pick-up unit 3. Then, the signal from each coil 36 is processed together with the signal from the respective pick-up 20, in order to remove noise or interference in the specific locality of that pick-up 20. Alternatively, the additional pick-up 35 may comprise just a single coil, the output of which is processed together with any one or more of the signals from the individual pick-ups 20 of the main pick-up unit 3.

In this way, cancellation or at least reduction of noise or interference is removed from the detected signal, during each tuning. The additional pick-up 35 may be utilised only during tuning, if desired, and not necessarily utilised during playing.

In another arrangement, the additional pick-up 35 may be adapted to detect the vibrations in the or each respective string 2, and with the main pick-up unit 3, provide noise cancellation in the well-known "humbucking" configuration of double-pole pick up.

The additional pick-up 35 may also receive the driving signal directly from the electromagnetic transducers 21, in order to subtract this from the signal detected from the main pick-up unit 3.

The control panel 6 may be supplemented or replaced by a remote control unit, to control automatic tuning.

Figure 4:
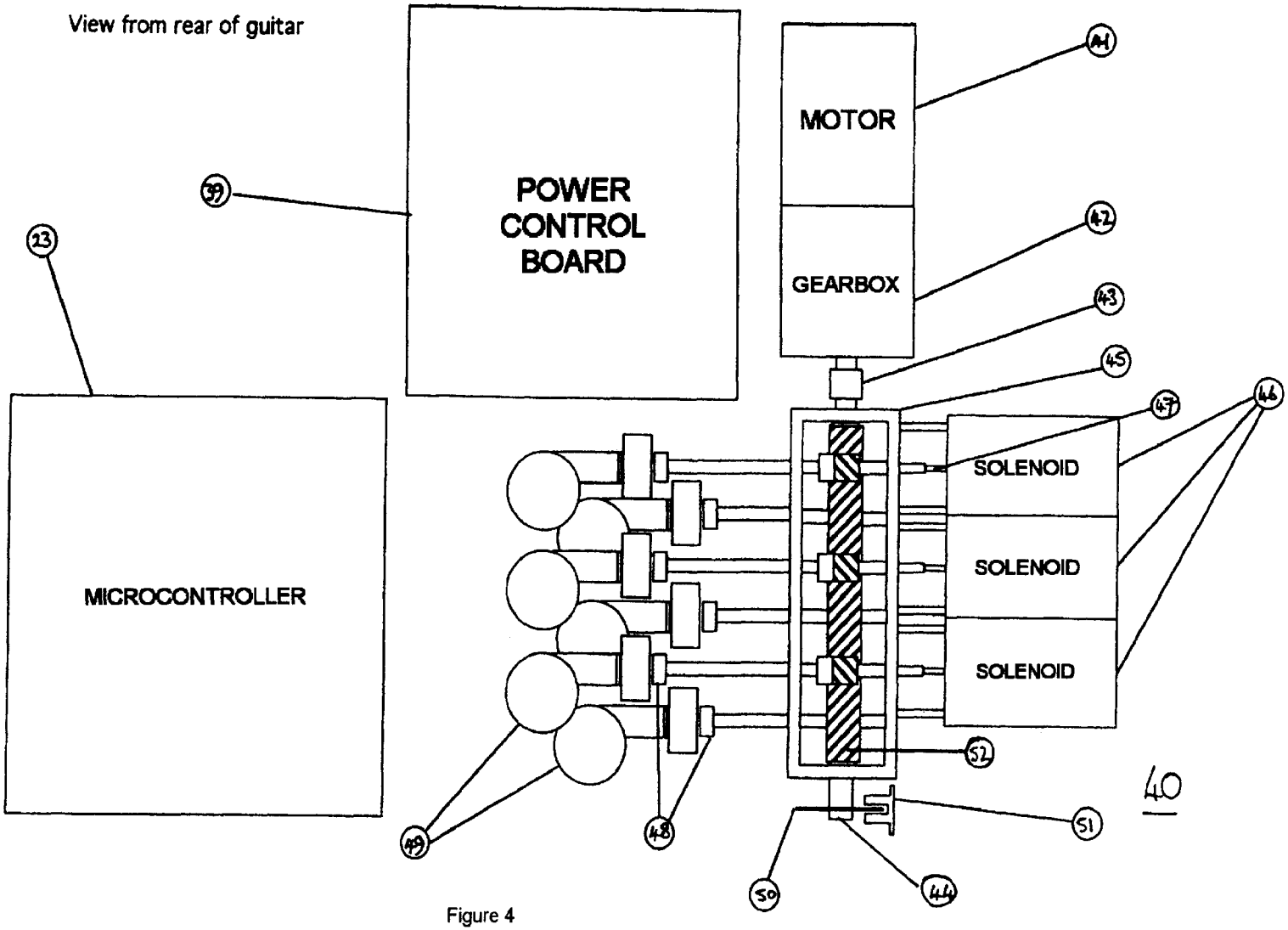
FIG. 4 is a schematic plan view of an alternative mechanical drive system for adjusting string tensions.
Figure 5:
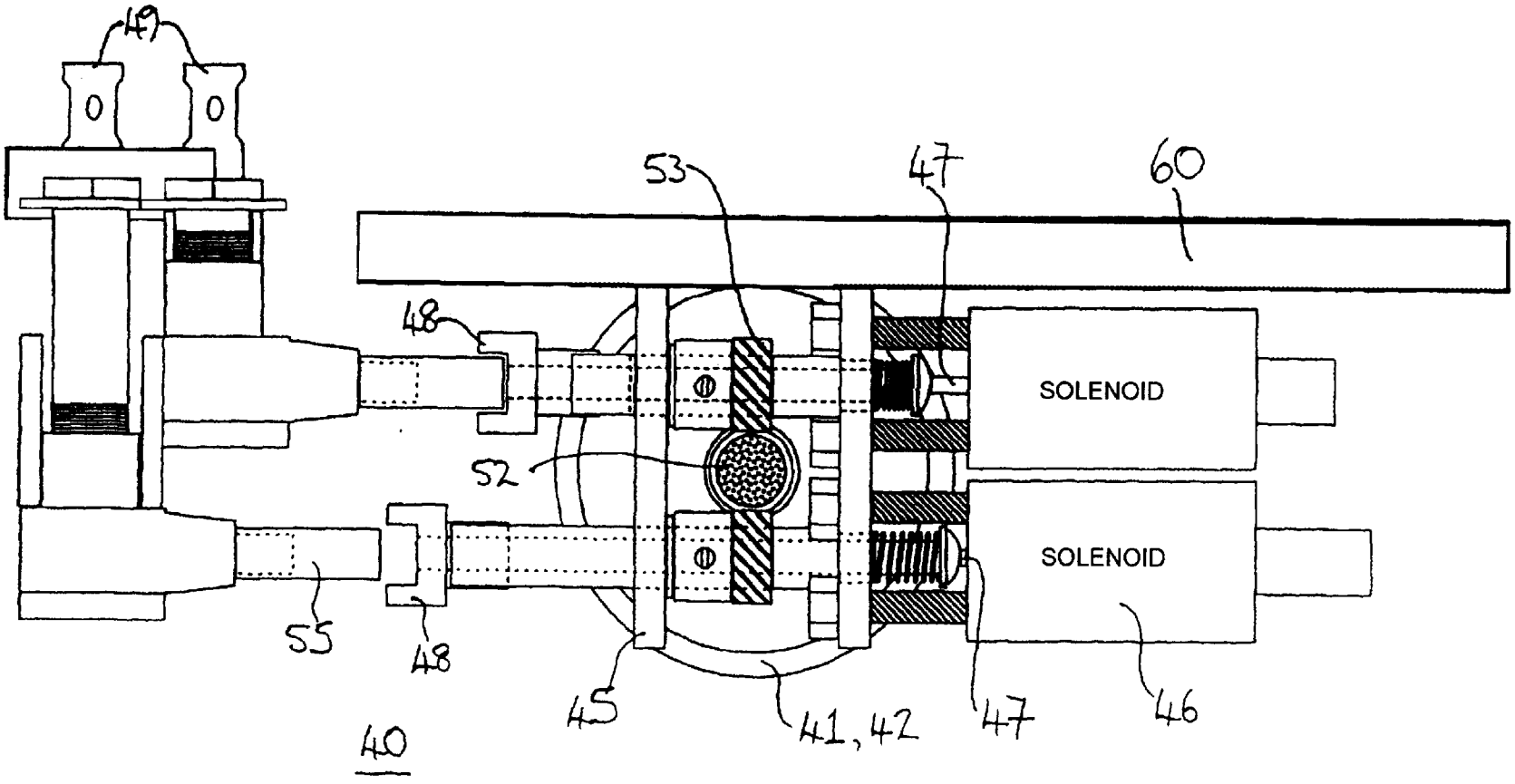
FIG. 5 is an end elevation of such a drive system.

FIGS. 4 and 5 show an alternative drive arrangement, for adjusting the tension of the guitar strings 2.

An electric motor 41 drives the shaft 44 of a worm and multiple wheel gearbox 45, via an in-line (epicyclic) gearbox 42 and a shaft coupling 43. At one end of the shaft 44, there is mounted a slotted wheel 50, which co-operates with a slotted opto-switch rotation sensor 51. The motor 41 is driven under the control of microcontroller 23. A power control board 39 is also shown.

In this arrangement, each of the strings 2 is tensioned by means of a respective tuning peg 49 in the form of a "machine head", comprising a worm-driven gear. Each of the machine heads 49 is driven via a respective clutch 48, which receives drive from the gearbox 45.

In the gearbox 45, there is provided a respective gear wheel 53 for each of the clutches 48. Each gear wheel 53 engages the worm 52 of the gearbox 45. For each gear wheel 53, there is provided a respective solenoid 46, having an output shaft 47 which is slideably connected through the respective gear wheel 53 with the respective clutch 48. Each clutch 48 engages and disengages with the drive shaft 55 of a respective one of the machine heads 49. Each solenoid shaft 47 is resiliently biased into a position in which the respective clutch 48 is disengaged. Upon activation of the respective solenoid 46, the shaft 47 is urged against the resilient bias to engage the clutch 48. The arrangement of the shaft 47 and its connection with the clutch 48, via the respective gear wheel 53, is such that, as the gear wheel 53 rotates, the clutch 48 and respective drive shaft 55 of the machine head 49 rotate with it.

The clutches 48 are shown only diagrammatically in FIGS. 4 and 5, but may take any desired form. For example, they may comprise meshing crown gears or the like, in the manner of a dog clutch.

As may be seen in the drawings, three of the gear wheels 53 are provided on top of the worm 52, and another three are provided below the worm 52, in staggered relationship with the top three. In the view of FIG. 5 (which also shows the top portion 60 of the guitar body), the upper clutch 48 is shown engaged, and the lower clutch 48 is shown disengaged.

Thus, in response to appropriate control from the microcontroller 23, the electric motor 41 is driven to rotate, and a selected one of the clutches 48 is engaged, to rotate the respective tuning peg 49 and adjust the tension in the respective string 2. The sensor 51 provides feedback information to the microcontroller 23, to give accurate information as to the position of the shaft 44 that is driven by the motor 41.

The tensions of strings 2 may be adjusted individually, or partly or wholly together, by engaging one of the clutches 48, or two or more of the clutches 48 simultaneously.

In this way, a very compact and efficient tensioning system 40 for use with the described automatic tuning system is provided. A benefit of using a drive arrangement of the type shown in FIGS. 4 and 5 is that the machine heads 49 can rotate in either direction indefinitely. This means that the system does not have to take into account any end position of the tension adjusting drive arrangement, as is the case in the arrangement shown in FIGS. 2 and 3.

Thus, by providing an automatic tuning system, only activated when required by the player, the accuracy of tuning can be assured through objective measurement, the time taken to reach the predetermined note minimised and the possibility of tuning to one of a plurality of chord patterns implemented, all in a noisy environment. The strings are resonated and tuned and the desired result confirmed without any manual intervention.

The electric guitar lends itself well to this approach. Inductive pickups can be used to detect individual string vibrations thus avoiding extraneous noise, the solid body guitar has room in which to incorporate the string tension adjusting devices and the signal processing electronics may also be housed in the same volume taking advantage of modern surface-mount-technology. Therefore the acoustics of the instrument are not affected by the inclusion of auxiliary components and the player will not have to carry substantial extra equipment. Indeed the player will only be aware of a small control panel, on the body of the guitar, to select predetermined chord patterns and to observe operation indicators.

Embodiments of the present invention not only provide automatic tuning to chord patterns but also resonate the strings so that the optimum tuning is accomplished, both in terms of accuracy and elapsed time as well as liberating the player to carry out other duties involved in preparing for a rehearsal or performance.

Various preferred tuning patterns can be employed. For example, the system may be programmed to tune the strings 2 to a predetermined chord or tuning pattern, correctly adjusted to absolute frequencies. Alternatively, a similar result may be achieved, but adjusted in dependence upon the frequency of a chosen string. For example, a player may tune any given string (eg bottom E) to another instrument, and the system then tunes the desired chord or other tuning pattern to the chosen string.

In another variation, the system may memorise any liked sound and reproduce it at any future desired time. That is, the player tunes the guitar until it has a sound that is liked. The tuning pattern is then stored in the system, for recall at any future time.

As indicated above, when the guitar is tuned, the overall pitch may be adjusted up and down as desired, either by preset amounts or to preset frequencies, or by an infinitely variable amount selected by the ear of the player. In other words, in the latter case, the player adjusts the overall frequency shift of the chosen tuning pattern, until it sounds acceptable to the player.

As also indicated above, the system may be arranged to tune just one, all or any of the strings at any given time. The control may be such that, when the common worm (or other) drive is in a given direction, all strings that require adjustment in that direction are engaged via their respective clutches 48, each of which is disengaged when the respective string has been adjusted sufficiently in that direction, if the drive is still continuing in that direction.

Upon power-up of the illustrated system, the control panel 6 may display the last selected tuning pattern, a default tuning pattern, or a selected start-up tuning pattern.

In order to compare detected and preset frequencies, embodiments of the invention preferably measure the time period of a detected frequency, and compare it with the time period of a desired, preset frequency.

Although the illustrated embodiments of the invention apply to tuning a guitar, the invention may be applied also to other stringed instruments.

In this specification, the verb "comprise" has its normal dictionary meaning, to denote non-exclusive inclusion. That is, use of the word "comprise" (or any its derivatives) to include one feature or more, does not exclude the possibility of also including further features.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. An automatic tuning system for a stringed musical instrument having a plurality of strings (2), the system comprising:

a. electrically driven resonating means (4) arranged to resonate a string (2) at its fundamental frequency, with an air gap between the resonating means (4) and the string (2);

b. resonating control means (22) arranged to drive the resonating means (4);

c. vibration detecting means (3) arranged to detect the mechanical vibration of the string (2) and to convert said vibration into a corresponding electrical signal;

d. comparing means (23) arranged to compare the frequency of said electrical signal with a predetermined frequency and to output a comparison signal;

e. adjusting means (5) arranged to adjust the tension in the string (2); and f. closed loop tuning control means (2,20,21,22) arranged to receive said comparison signal and automatically control operation of said adjusting means (5) until said comparison signal indicates that the frequency of said electrical signal is substantially equal to said predetermined frequency:

characterised in that:

g. the tuning system is adapted to be installed in the instrument as a permanent fixture such that:

i. said electrically driven resonating means (4) is mounted as a permanent fixture of the body (1) of the instrument such that it may resonate all of the strings (2) of the instrument;

ii. said vibration detecting means (3) is mounted as a permanent fixture of the body (1) of the instrument such that it may detect the mechanical vibration of all of the strings (2) of the instrument;

iii. said adjusting means (5) is mounted as a permanent fixture of the body (1) of the instrument such that it may adjust the tension of all of the strings (2) of the instrument;

iv. after installation, the tuning system maintains the tension of all of the strings (2) of the instrument during normal playing, via said adjusting means (5), and requires no assembly or disassembly to or from the instrument, in order to carry out tuning; and v. the tuning system makes no contact with the strings (2) of the instrument, both during normal playing of the instrument and during tuning, other than via said adjusting means (5).

2. An automatic tuning system according to claim 1, wherein said resonating control means (222) comprises electronic filter means arranged to progressively increase the permissible frequency of oscillation of the string (2) until resonance occurs.

3. An automatic tuning system according to claim 1, wherein said resonating control means (22) comprises low-pass filter means arranged to prevent resonance of the string (2) at a harmonic above its fundamental frequency, once resonance has been established.

4. An automatic tuning system according to claim 1, wherein said resonating control means (22) is a closed loop control means utilizing said resonating means (4) and said vibration detecting means (3), and arranged automatically to both initiate vibration of the string (2) and maintain resonance of the string (2) as said adjusting means (5) is adjusted.

5. An automatic tuning system according to claim 4, wherein said resonating control means (22) comprises phase control means arranged to maintain substantially 0 degrees of overall phase shift in an oscillating loop which includes the string (2), to maintain resonance of the string (2) as said adjusting means (5) is adjusted.

6. An automatic tuning system according claim 1, wherein said comparing means (23) is arranged to compare said frequencies by measuring the time period of said electrical signal and comparing it with the time period of said predetermined frequency.

7. An automatic tuning system according to claim 1, wherein said resonating means (4) comprises an electromagnetic transducer.

8. An automatic tuning system according to claim 7, wherein said resonating means (4) comprises a respective electromagnetic transducer element (21) for each string (2) to be tuned.

9. An automatic tuning system according to claim 1, wherein said vibration detecting means (3) comprises an electromagnetic transducer.

10. An automatic tuning system according to claim 9, wherein said vibration detecting means (3) comprises a respective electromagnetic transducer element (20) for each string (2) to be tuned.

11. An automatic tuning system according to claim 1, further comprising a noise detecting means (35) arranged to detect noise in the vicinity of said vibration detecting means (3), including noise from said resonating means (4), and combining means arranged to so combine signals from said vibration detecting means (3) and said noise detecting means (35) as to wholly or partially cancel noise common to both said vibration detecting means (3) and said noise detecting means (35).

12. An automatic tuning system according to claim 11, wherein said noise detecting means (35) comprises a pick-up coil mounted adjacent said vibration detecting means (3).

13. An automatic tuning system according to claim 1, wherein said adjusting means (5) comprises at least one electric motor (31,41).

14. An automatic tuning system according to claim 13, wherein said adjusting means (5) comprises one electric motor (31,41) and a plurality of drive selectors (25,48) to connect the drive of said one motor (31,41) selectively to respective ones of the strings (2).

15. An automatic tuning system according to claim 14, wherein each of said drive selectors (25,48) comprises a respective clutch (48).

16. An automatic tuning system according to claim 15, wherein a respective electromagnetic actuator (46) is provided to engage and disengage each respective clutch (48).

17. An automatic tuning system according to claim 14, wherein said adjusting means (5) comprises a worm drive (52) and a plurality of output gears (53), each of which engages the worm drive (52) and drives a respective output shaft (47) for a respective one of said strings (2).

18. An automatic tuning system according to claim 1, wherein said adjusting means (5) comprises for each string (2) a respective rotatable shaft (49) around which the string (2) is wound, such that rotation of the shaft (49) varies the tension in the string (2).

19. An automatic tuning system according to claim 18, wherein the or each said rotatable shaft (49) is adapted to be rotated by a gear (53) which rotates with the shaft (49) and is driven by a worm (52).

20. An automatic tuning system according to claim 1, further comprising a control panel or unit (6) by which a user can initiate and/or control a tuning operation.

21. An automatic tuning system according to claim 20, wherein said tuning control means (22,23) is arranged to tune all of the strings (2) to a predetermined tuning pattern, and said control panel or unit (6) includes means for setting said tuning pattern.

22. An automatic tuning system according to claim 21, wherein said tuning control means (22,23) stores a plurality of predetermined tuning patterns, and said control panel or unit (6) includes means for selecting one of said stored tuning patterns.

23. An automatic tuning system according to claim 22, wherein at least one of said plurality of predetermined tuning patterns comprises a predetermined chord.

24. An automatic tuning system according to claim 21, wherein said tuning control means (22,23) is arranged to detect the frequency of a selected string (2) and to tune all of the other strings (2) to a predetermined tuning pattern, based on said selected string (2).

25. An automatic tuning system according to claim 21, wherein said means for setting said storing pattern is arranged to store the tuning pattern of the strings (2) at any time selected by the user, and to subsequently retune the strings (2) to that tuning pattern.

26. An automatic tuning system according to any of claims 21 to 25, wherein said tuning control means (22,23) includes means for adjusting the pitch of all of the strings (2) in unison.

27. An automatic tuning system according to claim 20, wherein said control panel or unit (6) comprises a control panel mounted in or on the instrument.

28. An automatic tuning system according to claim 1, wherein said control panel or unit (6) comprises a control unit remote from the instrument.

29. An automatic tuning system according to claim 1, comprising signal processing electronics housed within the instrument.

30. An automatic tuning system according to claim 1, further comprising indicating means arranged to indicate the status of tuning, during tuning and/or upon completion of tuning.

31. An automatic tuning system according to claim 30, wherein said indicating means comprises an audible signal generator.

32. An automatic tuning system according to claim 30, wherein said indicating means comprises a visual display unit.

33. An automatic tuning system according to claim 1, arranged to tune the strings (2) individually, one at a time.

34. An automatic tuning system according to claim 1, arranged to tune some or all of the strings (2) simultaneously.

35. An automatic tuning system according to claim 1, arranged to tune a guitar.

36. A stringed musical instrument provided with an automatic tuning system according to claim 1.

37. A stringed musical instrument according to claim 36, being a guitar.

38. A stringed musical instrument according to claim 37, being an electric guitar.

* * * * *